United States Patent [19]

Julien

[11] 3,949,687

[45] Apr. 13, 1976

[54] DEVICE FOR USE WITH BUTTONHOLE ATTACHMENT

[76] Inventor: Howard B. Julien, P.O. Box 3456, Eureka, Calif. 95501

[22] Filed: June 16, 1975

[21] Appl. No.: 587,094

[52] U.S. Cl. ..... 112/77; 112/136

[51] Int. Cl.[2] ..... D05B 3/12

[58] Field of Search ..... 112/77, 75, 70, 66, 65, 112/131, 257, 115; 33/190, 189

[56] References Cited

UNITED STATES PATENTS

| | | | |
|---|---|---|---|
| 2,715,375 | 8/1955 | Spaine | 112/77 |
| 3,020,862 | 2/1962 | Gorton | 112/77 |
| 3,752,093 | 8/1973 | Loeffler | 112/75 |

*Primary Examiner*—H. Hampton Hunter
*Attorney, Agent, or Firm*—Warren, Chickering & Grunewald

[57] ABSTRACT

There is disclosed a device to limit the travel of a buttonhole attachment for a sewing machine wherein the button for which the hole is made serves to set the limit of travel. The device includes a bracket having a front wall and a back wall with the front wall fixed to the buttonhole attachment, a limit which is positioned in front of the front wall and fixed to a shaft which in turn is movably attached to both the front wall and the back wall of the bracket and biased to move toward the front wall, and a stop fixed to the shaft between the front wall and the back wall, with the bracket adapted to provide access to insert a button between the front wall and the stop.

5 Claims, 2 Drawing Figures

DEVICE FOR USE WITH BUTTONHOLE ATTACHMENT

BACKGROUND OF THE INVENTION

Buttonholes are made in fabrics by binding the edges of a slit in the fabric. The slit is long enough to pass the button edgewise, but not so long that the button can be pulled through it when its wide face is in contact with the fabric. Buttonholes generally are made with sewing machines by providing a binding with a zigzag stitch, after which the fabric is slit between side-by-side binding. The stitch is readily regulated by setting the sewing machine, and a simple and inexpensive buttonhole attachment can be used to hold the fabric flat and to guide the needle along a straight path to produce an even and straight binding for the buttonhole.

Buttonhole attachments usually include two elements. One element is movable with respect to the sewing machine but fixed with respect to the fabric, and the other element is fixed with respect to the sewing machine but movable with respect to the fabric. The elements move with respect to each other by having the element that is movable with respect to the fabric riding in side rails formed in the element that is fixed with respect to the fabric.

When preparing a buttonhole, one usually measures the length of the button and marks a line on the fabric that is ⅛-inch longer than the button diameter. After the fabric is marked, the buttonhole attachment is placed so that the mark will appear in a slot in the bottom of the buttonhole attachment. The sewing machine is then operated to produce a suitable binding stitch along one side of the line; and when the top of the slot is reached, the sewing machine is reversed and a suitable binding is then run along the other side of the line until a complete binding is obtained.

It is necessary for the operator to observe when the binding has been made along the entire length of the slit and to, at that point, move the fabric over and reverse the sewing machine to complete the binding. When many buttonholes of the same size are to be made, it is not necessary to mark the length of each buttonhole on the fabric because buttonhole attachments ordinarily have a rough scale along one rail that can be used to guage the length of the hole.

Since buttonholes ordinarily are placed in finished articles, it is extremely important that the buttonholes be the right length for the button being used. Buttonholes of the wrong size may be very wasteful and may require remaking the entire buttonhole if it is too small, obtaining larger buttons if the buttonholes are too large, or in extreme cases wasting an already made article.

THE INVENTION

This invention is a device for use with a buttonhole attachment. The device of this invention avoids or greatly mitigates all of the problems normally encountered with buttonhole attachments. The device of this invention avoids the necessity for estimating the length of a buttonhole in that it employs the button to be used as the means to establish the length of the hole. Additionally, the device of this invention eliminates the need to visually gauge the length of the buttonhole by observing a mark on the fabric or by using the scale on a buttonhole attachment in that the device of this invention automatically stops the feed of the sewing machine when a buttonhole binding of the correct length has been made.

The device of this invention includes a bracket having at least a front wall and a rear wall with the front wall adapted to be fixed in the side rails of a buttonhole attachment. In front of the front wall, a limit element extends into the buttonhole attachment. The limit element may also be adapted to ride in the rails of the buttonhole attachment, or it may simply extend in front of the front wall. The limit element is fixed to a shaft that is movably attached to both the front wall and the rear wall of the bracket, and the same shaft is provided with a stop positioned on the shaft and between the front wall and the rear wall of the bracket. Finally, the device of this invention has a spring which biases the shaft to move toward the front wall or toward a position which moves the limit away from the front wall. The bracket is provided with an opening that is suitable for inserting a button between the stop and the front wall of the bracket.

DETAILED DESCRIPTION OF THE INVENTION

This invention may be better explained with reference to the accompanying drawings.

Figure 1:
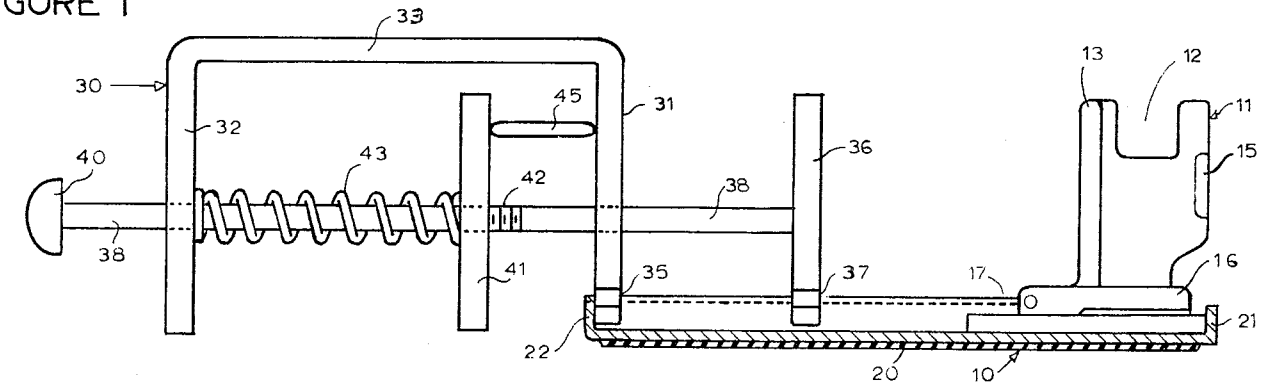
FIG. 1 illustrates a side view in section along the line 1—1 of FIG. 2 illustrating a device embodying this invention connected to a conventional buttonhole attachment.
Figure 2:
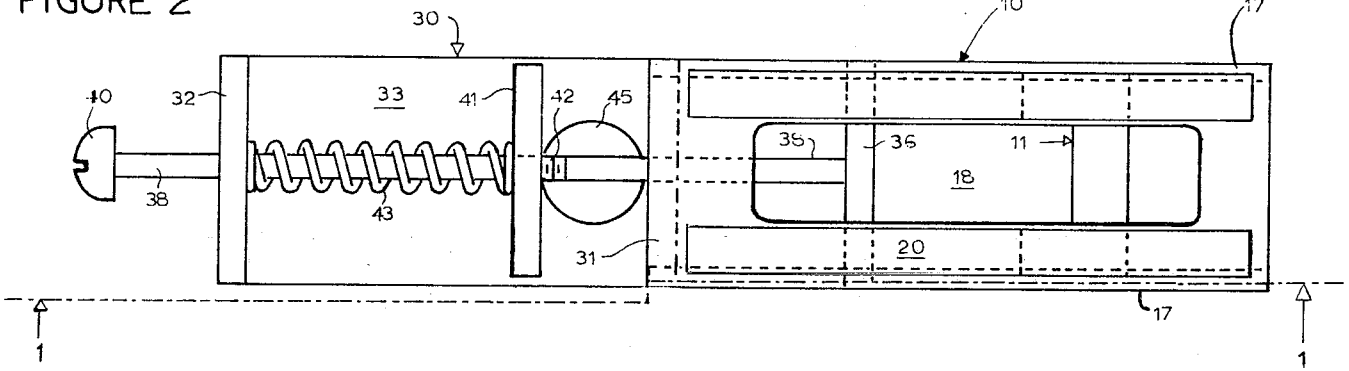
FIG. 2 is a bottom view of the device illustrated in FIG. 1.

The conventional buttonhole attachment is generally designated 10. The attachment includes an element 11 that is connected to a sewing maching through the indentation 12 and properly aligned with the needle assembly of the sewing machine with flanges 13 and 15. The buttonhole attachment includes a sliding element 16 which rides in rails 17 so that it moves along the longitudinal axis of the attachment. In the illustrations, the assembly 11 will move from left to right. The assembly 11 moves over a slot 18 so that the needle of the sewing machine will pass through the slot 18 and will sew fabric that is positioned beneath the slot 18. It is preferred that a nonslip material 20 be fastened to the bottom of the buttonhole attachment 10 in that the element of the buttonhole attachment that includes the rail 17 should not move with respect the the fabric being sewed.

When the device of the present invention is not being employed, one making a buttonhole will normally measure the diameter of the button, draw a line on the fabric that is ⅛-inch longer than the diameter of the button, position the fabric so that that line is parallel with the long sides of the slot 18 and in the center of the slot 18, after which the sewing machine is operated in the normal manner to produce a buttonhole binding stitch along one edge of the line, and when the binding is the full length of the mark on the fabric to sew a few bar tack stitches and then to position on the other side of the line and reverse the process to complete the binding for the buttonhole. The process as thus described requires accurately measuring the diameter of the button, adding an increment of length to that diameter, accurately drawing a line on the fabric a length equal to the diameter of the button plus that increment, visually observing when a buttonhole binding has been made from one end of that line to the other, and then properly positioning a bar tack stitch before completing the binding on the other side of the buttonhole.

The device of the present invention is generally represented as 30. The device includes a front wall 31, a rear wall 32, and structural means 33 to maintain the spacing and alignment between the front and the rear walls. The front wall 31 includes a groove 35 which is of the proper shape to engage the rails 17 of the buttonhole attachment 10. The device of this invention also includes a limit element 36 which also is provided with a groove 37 to engage the rail 17 of the button hole attachment 10. The limit element 36 is fixed to the end of a shaft 38 which passes through a hole in front wall 31 and a hole in rear wall 32 and terminates in an expanded element 40 which is preferably a screwhead. Between the front and rear walls of the device 30, a stop element 41 is fixed. It is preferred that the stop element 41 be positioned on a threaded portion 42 of the shaft 38 so that the position at which it is fixed to the shaft 38 may be varied somewhat depending upon whether the buttonhole is being prepared for a normal thickness button or an extra thickness button, as will be described hereinafter. A spring 43 is positioned to bear against a rear wall 32 and the stop element 41 to urge the stop element 41 toward the front wall 31.

The operation of the device is as follows. The stop element 41 is adjusted on shaft 42 to a position such that when the element 41 is in contact with front wall 31, limit element 36 will occupy a position between the rails 17 such that the device 11 will move ⅛ inch before it contacts limit element 36. This is the setting to be used for ordinary buttonholes. The device of this invention can easily be installed between the rails 17 by placing limit element 36 in contact with front wall 31, placing both front wall 31 and limit element 36 between the rails 17 and at acute angle to the axis of slot 18, and then twisting them to be perpendicular to the long axis of the slot 18, in which position the grooves 35 and 37 engage the rails and become firmly fixed between them. When limit element 36 is released, it slides forward between the rails; and the separation between the element 36 and front wall 31 rigedly fixes the device of this invention between the rails 17 and in axial alignment with the buttonhole attachment 10. When properly adjusted, the limit element 36 is in a position such that element 11 can travel only ⅛-inch before it makes contact with limit element 36.

When it is desired to make a buttonhole the proper length for the button 45, the button 45 is placed between stop 41 and front wall 31 of the device 30. The button in such position causes the limit element 36 to retract a distance exactly equal to the diameter of the button, and in such position the movable element 11 may move a distance exactly equal to the diameter of the button plus ⅛-inch, which is the proper length of the buttonhole for the button 45. Accordingly, the operator of the sewing machine need only sew a buttonhole binding until the movable element 11 contacts the limit element 36 after which a bar tack stitch is employed, the sewing machine reversed, and the other side of the buttonhole binding made in the usual manner.

When buttons are abnormally thick, it is necessary to make the buttonholes to be used with them slightly longer than ⅛-inch longer than the diameter of the button. The very limited threaded area on the shaft 38 may accommodate for this. Thus, if a very wide button is employed, the stop element 41 can be turned to the forwardmost portion of the threaded area 42 to add, for example, an additional 1/16-inch to the buttonhole by being in such position that when stop element 41 is in contact with front wall 31, the limit element 36 is 3/16-inch from the movable element 11 of the buttonhole attachment. Such pre-set positions may be achieved with means other than a threaded shaft — for example, by inserting a spacer element between the front wall 31 and the stop element 41. Equivalent means may be substitued within the scope of this invention for other elements of the device as illustrated.

What is claimed is:

1. A device to limit the travel of a buttonhole attachment for a sewing machine, said attachment including an element that is not movable relative to the fabric being worked on, which unmovable element has side rails, and an element movable with respect to the fabric being worked on, said movable element being movable along said side rails, said device comprising:

a. a bracket having a front wall adapted to be fixed in said side rails and a rear wall, b. a limit element extending beyond said front wall and adapted to be movable between said side rails, c. a shaft movably attached to said front wall and said rear wall and fixed to said limit element, d. a stop fixed to said shaft between said front wall and said rear wall, e. means biasing said shaft to drive said limit element away from said front wall, and f. an opening in said bracket to receive a button between said front wall and said stop element.

2. The device of claim 1 wherein said shaft passes through aligned holes in said front wall and said rear wall.

3. The device of claim 1 wherein said stop element is adapted to be fixed to different portions of said shaft.

4. The device of claim 3 wherein said stop element is adapted to be fixed between preselected positions on said shaft.

5. The device of claim 1 wherein said bracket includes a front wall, a back wall, and a single bridging element connecting to the upper portion of said front wall and to the upper portion of said rear wall.

* * * * *